US006004096A

United States Patent [19]

Young

[11] Patent Number: 6,004,096

[45] Date of Patent: Dec. 21, 1999

[54] HYDRO-SURGE BOWL VALVE

[75] Inventor: William D. Young, Lubbock, Tex.

[73] Assignee: American Turbine Pump Co. Inc., Lubbock, Tex.

[21] Appl. No.: 09/001,018

[22] Filed: Dec. 30, 1997

[51] Int. Cl.[6] ..... F01B 25/00

[52] U.S. Cl. ..... 415/146; 415/901

[58] Field of Search ..... 415/146, 901

[56] References Cited

U.S. PATENT DOCUMENTS

| | | | |
|---|---|---|---|
| 667,091 | 1/1901 | Ivens | 415/146 X |
| 2,082,996 | 6/1937 | Wintroath | 415/146 |
| 2,311,963 | 2/1943 | Pyle | 415/901 X |
| 3,025,800 | 3/1962 | Wolfe et al. | 415/172.1 X |
| 3,070,026 | 12/1962 | Lung | 415/199.3 |
| 3,747,840 | 7/1973 | Weiland . | |
| 3,807,894 | 4/1974 | O'Rourke . | |
| 3,854,848 | 12/1974 | Laing . | |
| 4,021,137 | 5/1977 | Zehren . | |
| 4,234,290 | 11/1980 | Lobach . | |

FOREIGN PATENT DOCUMENTS

| | | | |
|---|---|---|---|
| 29019782 | 4/1929 | Netherlands | 415/146 |
| 193994 | 2/1938 | Sweden | 415/146 |

OTHER PUBLICATIONS

Brochure entitled "American Turbine—Vertical Turbine & Submersible Pumps".

*Primary Examiner*—John E. Ryznic

*Attorney, Agent, or Firm*—Nelson R. Capes; Mackall, Crounse & Moore, PLC

[57] ABSTRACT

A gravity-operated anti-surge valve for a turbine pump consists of a poppet adapted to be moveable under fluid pressure between a closed position and a valve seat for the poppet. The weight of the poppet biases the poppet in the closed position against the valve seat in the absence of fluid pressure. Fluid pressure developed by the pump forces the poppet open. As fluid pressure decreases when the pump is shut off, the weight of the poppet allows the poppet to gradually close against continuing fluid flow, preventing water hammer. As fluid pressure approaches zero, the poppet completely closes, preventing the weight of a column of water from rushing down the lineshaft at high speed and driving the pump impellers in reverse. The valve is located above the top bowl of the pump.

23 Claims, 13 Drawing Sheets

HYDRO-SURGE BOWL VALVE

BACKGROUND OF THE INVENTION

A typical deep-running, lineshaft turbine pump of the prior art is shown in FIGS. 1 and 2. The turbine pump 10 consists of a driver 12, such as an electric motor, a lineshaft 14 driven by the driver 12, a plurality of impellers 16 driven by the lineshaft 14, a column pipe 18 enclosing the lineshaft 14, and a bowl 20 above the impellers 14. The lineshaft 14 runs on a plurality of bearings 22 distributed at intervals along the lineshaft 14. Fluid is brought into the pump 10 through a suction case 24 and is discharged from the pump 10 through a discharge pipe 26. A typical environment in which the turbine pump 10 operates is shown in FIG. 2. The pump 10 is inserted in a well W drilled into the surface S of the earth. A body of fluid F, such as oil or water, is deep in the earth, perhaps several hundreds of feet. The pump 10 is positioned such that the suction case 24 is within the body of fluid F, with the discharge case above the surface S of the earth. Power from the driver 12 is distributed to the impellers 16 by the lineshaft 14, producing suction within the suction case 24, drawing fluid F into the suction case 24. Fluid is forced by the impellers 16 into the bowl 20, and from the bowl 20 into the column pipe 18. Fluid travels up the column pipe 18 to the discharge pipe 26, where it is pumped out. Deepwell lineshaft turbine pumps such as the pump 10 need a device to keep the pump from running backwards if the pump stops due to power failure or normal shutdown. When a pump is shut off, fluid runs back down the column pipe 18 at a very high speed. The force backflow hits and runs the impellers 16 spinning the pump backwards. The centrifugal force developed during backspin can tear the windings out of the rotor of the electric motor which may be used for the driver 12. If a gear drive is used instead, the force will damage the engine that drives it. In addition, pumps 10 are of two types: oil lubricated and product lubricated. In the product lubricated type, the bearings 22 are actually lubricated by the fluid being pumped by the pump. If the pump shuts off, the fluid level drops down the column pipe 18 leaving the bearings 22 running dry, burning the rubber and scoring the shaft 14. In the past, this problem has been addressed by non-reverse ratchets or sprags attached to the driver 12 to prevent the driver 12 from running backward, or by footvalves within the suction case 24. However, such devices can fail during reverse spin because of the horsepower generated by the impellers 16. Furthermore, the pressure developed on footvalves may cause the suction case 24 to fail. Also, these devices stop flow abruptly so that backflow still puts force on the impellers and inflicts torque on the lineshaft. There is a need for an anti-surge valve for such deep-running lineshaft pumps which will solve the backflow problem and avoid the problems of non-reverse ratchets or footvalves.

SUMMARY OF THE INVENTION

A gravity-operated anti-surge valve for a turbine pump consists of a poppet adapted to be moveable under fluid pressure between a closed position and an open position and a valve seat for the poppet. The weight of the poppet biases the poppet in the closed position against the valve seat in the absence of fluid pressure. Fluid pressure developed by the pump forces the poppet open. As fluid pressure decreases when the pump is shut off, the weight of the poppet allows the poppet to gradually close against continuing fluid flow, preventing water hammer. As fluid pressure approaches zero, the poppet completely closes, preventing the weight of a column of water from rushing down the lineshaft at high speed and driving the pump impellers in reverse. The valve is located above the top bowl of the pump.

A principal object and advantage of the present invention is that it prevents damage to a pump driver or to the suction case due to the high speed and weight of water which rushes back down a column pipe when the pump is shut off.

Another principal object and advantage of the present invention is that it prevents damage to the lineshaft bearings and the lineshaft caused by reverse fluid flow draining the lubricating fluid out of the column pipe in a product lubricated pump.

Another object and advantage of the present invention is that it is preferably placed in the top intermediate bowl of the pump at the point of an existing constriction and therefore does not introduce further flow constriction and maintains pump efficiency.

Another object and advantage of the present invention is that the valve closes while fluid is still flowing upward in the column pipe, thereby eliminating the water hammer effect from backflow.

Another object and advantage of the present invention is that the valve is located within the pump, rather than being attached to the pump.

Another object and advantage of the present invention is that it prevents backflow from ever reaching the impellers.

Another object and advantage of the present invention is that it has a self-draining feature that allows a steady seepage of fluid past the valve after the valve closes. Eventually, the fluid level will drop to a static level. This reduces the weight of fluid within the column pipe, thereby making the removal of the pump for maintenance or repair easier.

BRIEF DESCRIPTION OF THE DRAWINGS

FIG. 11 is a schematic of the valve of the present invention within a turbine pump showing the position of the valve when the pump is on.

DETAILED DESCRIPTION OF THE PREFERRED EMBODIMENTS

Figure 1:
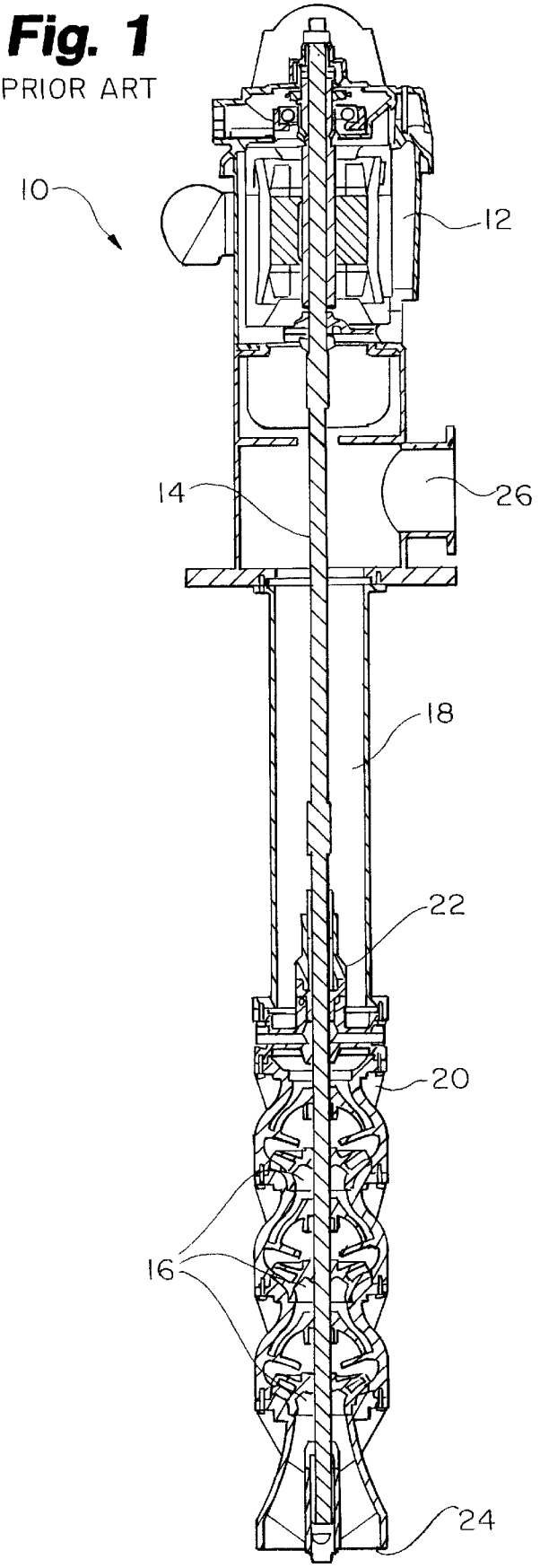
Fig. 1 PRIOR ART
FIG. 1 is a schematic of a turbine pump of the prior art.
Figure 2:
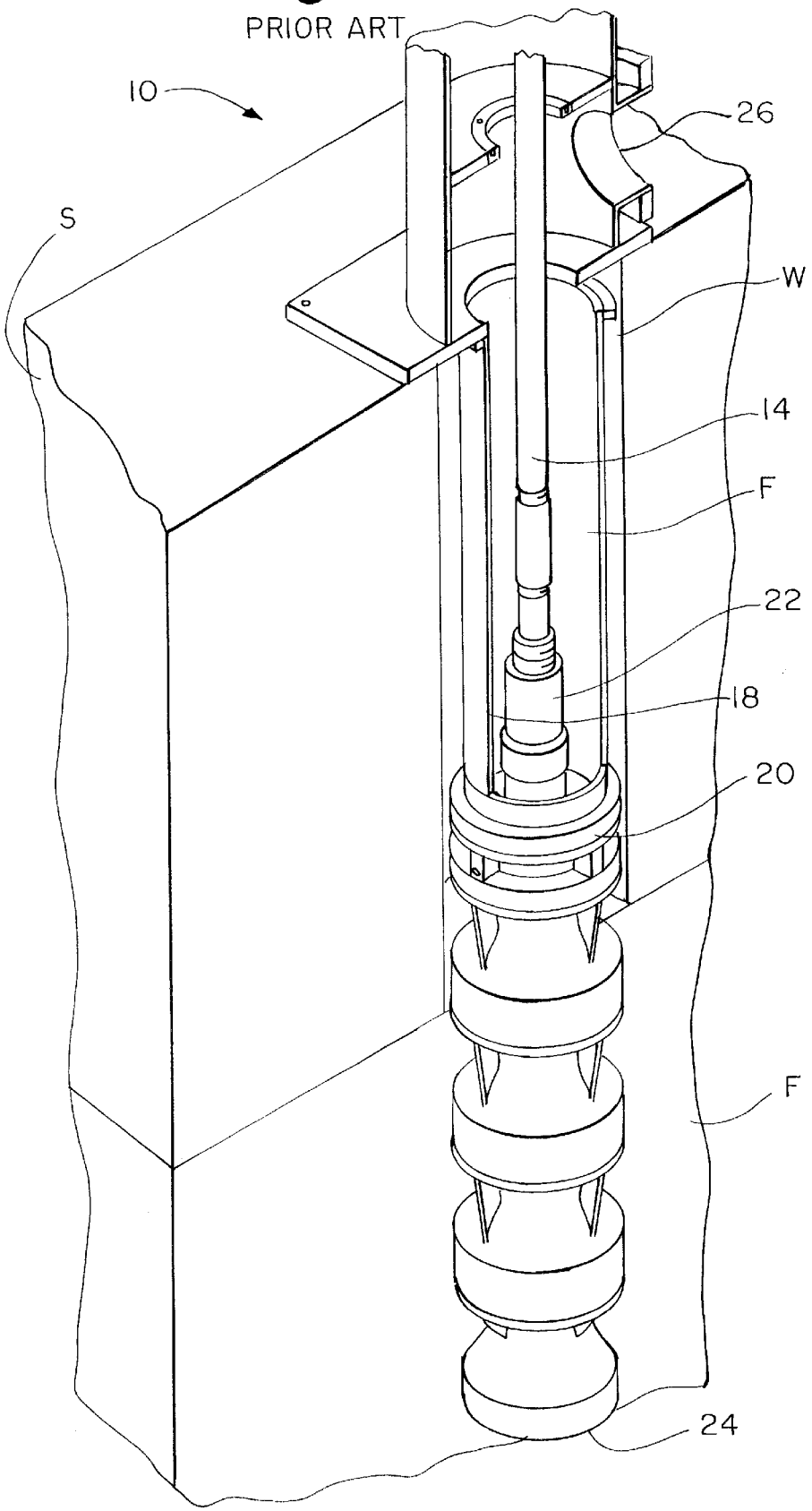
Fig. 2 PRIOR ART
FIG. 2 is a schematic showing the environment in which turbine pumps operate.

The gravity-operated anti-surge valve of the present invention is generally designated in the Figures by reference numeral 110.

Figure 3:
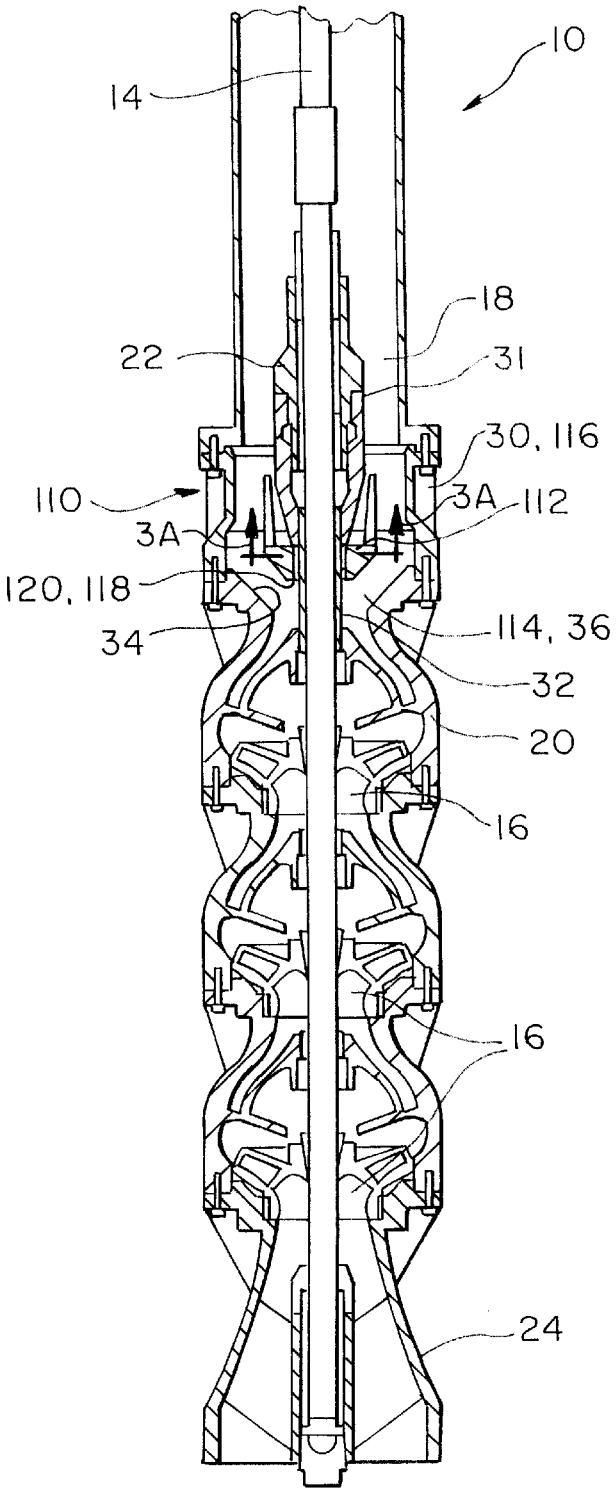
FIG. 3 is a schematic of an oil-lubricated turbine pump showing a first embodiment of the invention.
Figure 3A:
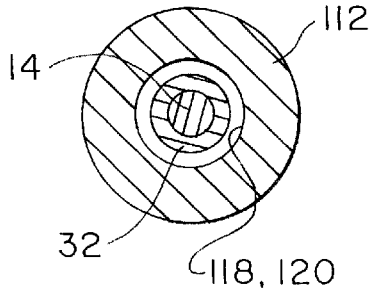
FIG. 3A is a cross-section along the lines 3A of FIG. 3.

A first embodiment of the valve 110 of the present invention to be used in an oil-lubricated turbine pump 10 is shown in FIG. 3.

The valve 110 comprises a poppet 112 which is moveable under fluid pressure between a closed position and an open position. The valve 110 also comprises a valve seat 114 which engages the poppet 112 in the closed position. FIG. 3 shows the valve 110 in the open position. The weight of the poppet 112 will bias the poppet 112 against the valve seat 114 in the absence of fluid pressure, as will be discussed below. No springs are needed for operation of the valve, thus simplifying construction and operation and reducing the likelihood of failure.

Preferably, the valve 110 is located within the pump 10 above the bowl 20 and below the column pipe 18. When located in this position, the valve 110 does not introduce significant additional flow restriction beyond the flow restriction present in the bowl 20, thus maintaining the efficiency of the pump. Other locations for the valve are, however, possible. FIGS. 3 through 6 show embodiments of the valve for use in an oil-lubricated pump.

In the environment of these embodiments, an oil-lubricated pump 10 has a discharge case 30 between the bowl 20 and the column pipe 18. A T-bearing 31 connects the lineshaft 14 to the discharge case 30. A throttle bearing 32 surrounds the lineshaft 14 within the discharge case 30. It should be understood that the foregoing environment description describes the standard parts present in any oil-lubricated turbine pump.

In the first embodiment, the poppet 112 preferably slidingly engages the lineshaft 14 within the discharge case 30. In this embodiment, the discharge case 30 has an inner surface 34, a portion 36 of which is used as the valve seat for the poppet 112. The poppet 112 preferably slides up and down on the throttle bearing 32, which surrounds a portion of the lineshaft 14.

The valve 110 also has a retainer means 116 for restraining the movement of the poppet 112 on the lineshaft 14 in a direction away from the bowl 20. This prevents the poppet 112 from being driven up the lineshaft 14 by fluid pressure. The retainer means 116 does allow enough movement of the poppet 112 to open the valve. The retainer means also reduces the closure time for the valve 110 by limiting the distance through which the poppet 112 must move to open the valve, and also thus minimizes water hammer during closing of the valve.

In the first embodiment shown in FIG. 3, the retainer means 116 is the discharge case 30. Because a discharge case is present in every oil-lubricated pump, there is no need to modify or add a part to produce a retainer means.

The valve 110 also preferably comprises self-draining means 118 for allowing gradual drainage of fluid in the column pipe 18 above the valve 110. This allows for fluid to gradually drain out of the column pipe 18, reducing the weight of fluid in the column pipe 18 and making removal of the pump easier. This is important in deep-running pumps, which may be placed several hundred feet underground and therefore have an enormous weight of water in the column pipe 18.

Preferably, the self-draining means 118 comprises a gap or channel 120 between the poppet 112 and the throttle bearing 32. It will be seen that when the valve 110 is closed, fluid may still drain past the poppet 112 through the gap 120. Most preferably, the gap is about 0.080 inch. Applicant has found that a gap of about this size maximizes the efficiency of the valve while still allowing drainage in a reasonable time. It should be understood that all embodiments of the pump 10 described herein preferably have such self-draining means 118 or gap 120.

Figure 4:
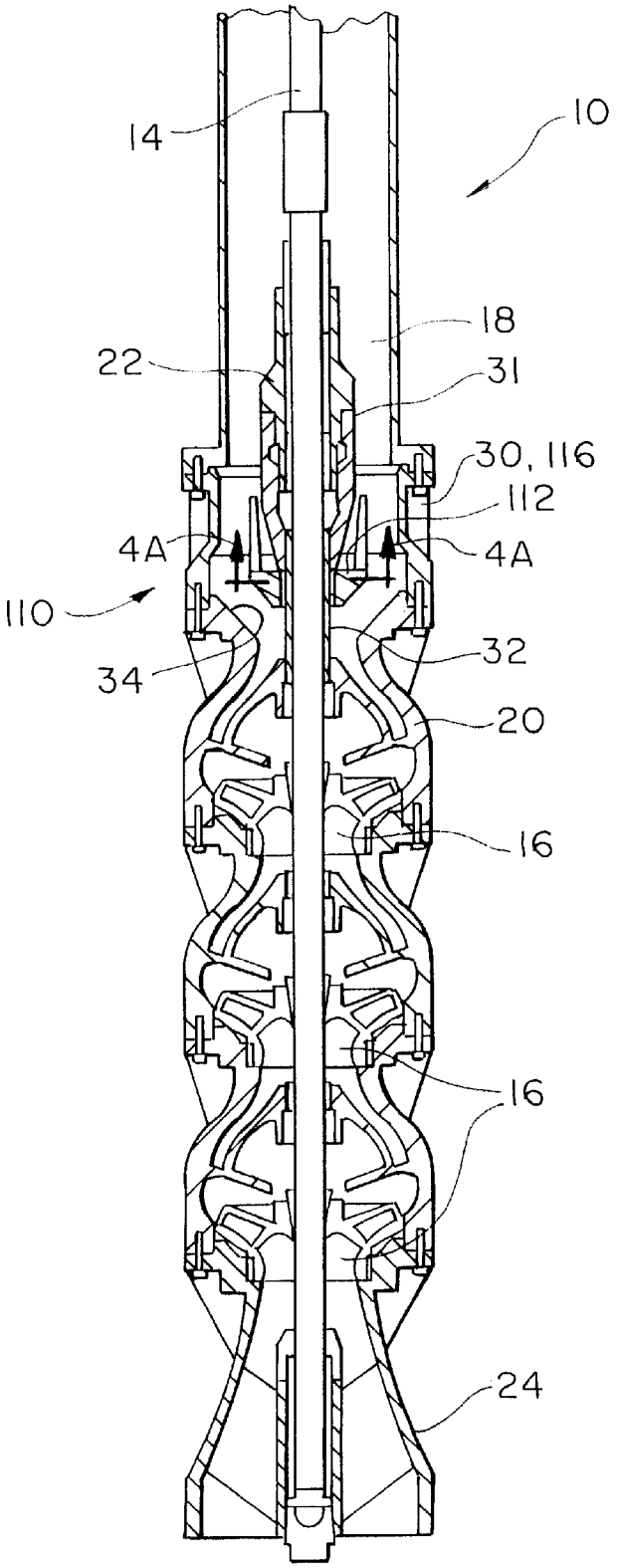
FIG. 4 is a schematic of an oil-lubricated turbine pump showing a second embodiment of the invention.
Figure 4A:
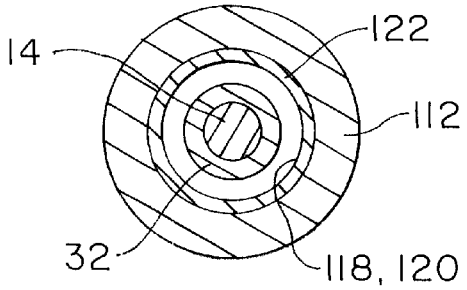
FIG. 4A is a cross-section along the lines 4A of FIG. 4.

FIG. 4 shows a second embodiment of the valve 110 within an oil-lubricated pump 10. The second embodiment is the same as the first embodiment with the addition of a metallic insert 122 on the poppet 112. The poppet 112 is preferably composed of ductile iron, although it may be made from other materials such as stainless steel, brass, or carbon steel. If the poppet 112 is made of a rusting material such as ductile iron, the metallic, non-rusting insert 122 is necessary to allow free movement of the poppet 112 along the throttle bearing 32. It should be noted that the preferably 0.080 inch gap is still present between the metallic insert 122 and the throttle bearing 32, to allow self-draining. The metallic insert is preferably brass.

Figure 5:
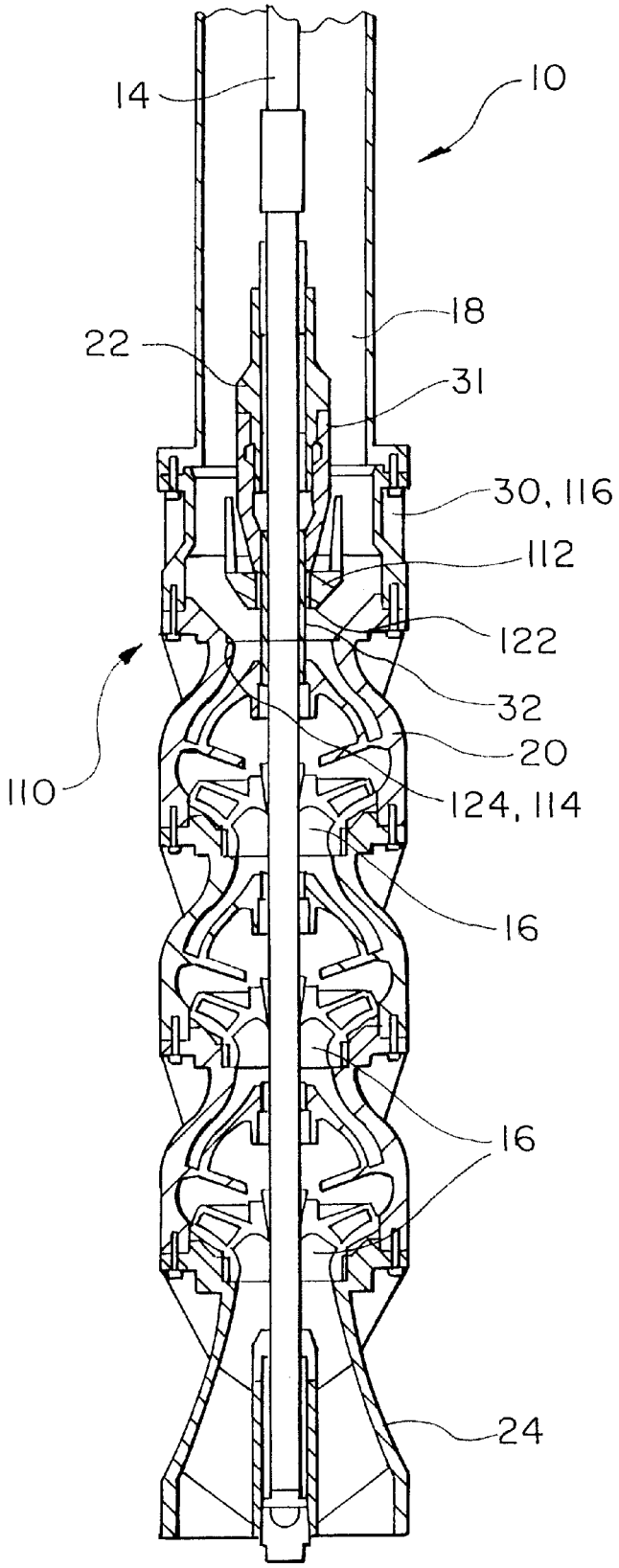
FIG. 5 is a schematic of an oil-lubricated turbine pump showing a third embodiment of the invention.

FIG. 5 shows a third embodiment of the valve 110 within an oil-lubricated pump 10. The third embodiment is the same as the first embodiment or second embodiment with the addition of a metallic adapter 124 to the discharge case 30. The metallic adapter 124 is located at the portion 36 of the discharge case 30 where the poppet 112 engages the discharge case 30. The metallic adapter 124 thus acts as a valve seat 114 for the poppet 112. Thus, if the discharge case is made out of a rusting metal, such as ductile iron, the non-rusting adapter 124 provides a secure valve seat. Preferably, the adapter 124 is made of brass.

Figure 6:
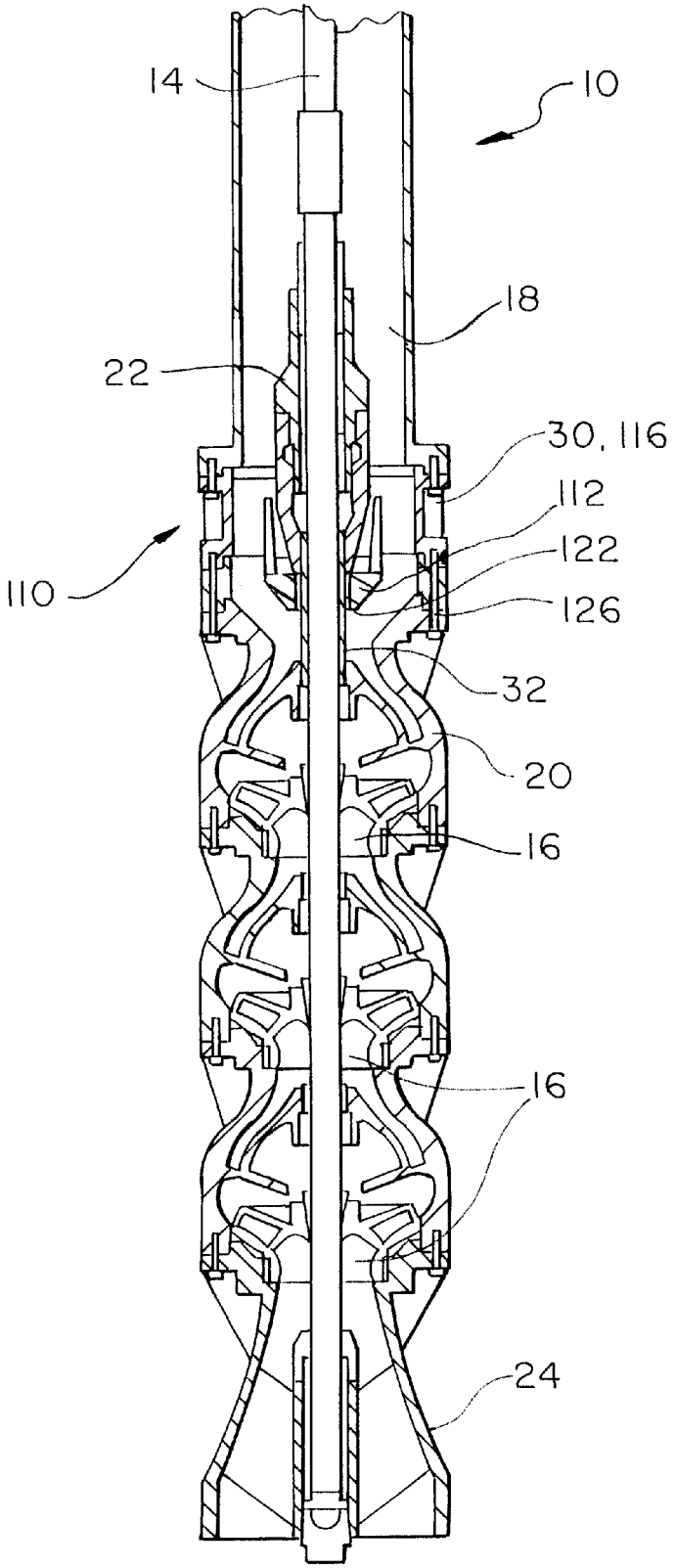
FIG. 6 is a schematic of an oil-lubricated turbine pump showing a fourth embodiment of the invention.

FIG. 6 shows a fourth embodiment of the valve 110 within an oil-lubricated pump 10. The fourth embodiment is the same as the first embodiment or second embodiment with the addition of a spacer 126 to the discharge case 30. Some discharge cases may not be large enough to accommodate travel of the poppet 112 from the closed to the open position. The spacer 126 enlarges the discharge case to provide space within the discharge case 30 for travel of the poppet 112.

FIGS. 7 through 10 show embodiments of the valve 110 in a product-lubricated pump.

There is no discharge case in a product-lubricated pump. Instead, the column pipe 18 is connected to the bowl 20 by means of a coupling ring 130. The poppet 112 preferably slidingly engages the lineshaft 14 within the coupling ring 130. In this embodiment, the coupling ring 130 has an inner surface 134, a portion 136 of which is used as the valve seat for the poppet 112. The poppet 112 slides up and down on the line shaft.

The valve 110 also has a retainer means 116 for restraining the movement of the poppet 112 on the lineshaft 14 in a direction away from the bowl 20. This prevents the poppet 112 from being driven up the lineshaft 14 by fluid pressure. The retainer means 116 does allow enough movement of the poppet 112 to open the valve. The retainer means also reduces the closure time for the valve 110 by limiting the distance through which the poppet 112 must move to open the valve, and also thus minimizes water hammer during closing of the valve.

A product-lubricated pump does not have a discharge case. Therefore, the discharge case cannot be used as the retainer means 116. Also, a product-lubricated pump does not have a throttle bearing. To provide a retainer means 116 for the poppet 112, a throttle bearing 32 is added to an unmodified product-lubricated pump. The throttle bearing 32 is modified to have a stop 128. The stop 128 restrains the motion of the poppet 112 in the direction away from the bowl 20. The stop 128 is the retainer means 116 in a product-lubricated pump.

The valve 110 also preferably comprises self-draining means 118 for allowing gradual drainage of fluid in the column pipe 18 above the valve 110. This allows for fluid to gradually drain out of the column pipe 18, reducing the weight of fluid in the column pipe 18 and making removal of the pump easier. This is important in deep-running pumps, which may be placed several hundred feet underground and therefore have an enormous weight of water in the column pipe 18.

Preferably, the self-draining means 118 comprises a gap 120 between the poppet 112 and the throttle bearing 32. It will be seen that when the valve 110 is closed, fluid may still drain past the poppet 112 through the gap 120. Most preferably, the gap is about 0.080 inch. Applicant has found that a gap of about this size maximizes the efficiency of the valve while still allowing drainage in a reasonable time. It should be understood that all embodiments of the pump 10 described herein preferably have such self-draining means 118 or gap 120.

Figure 7:
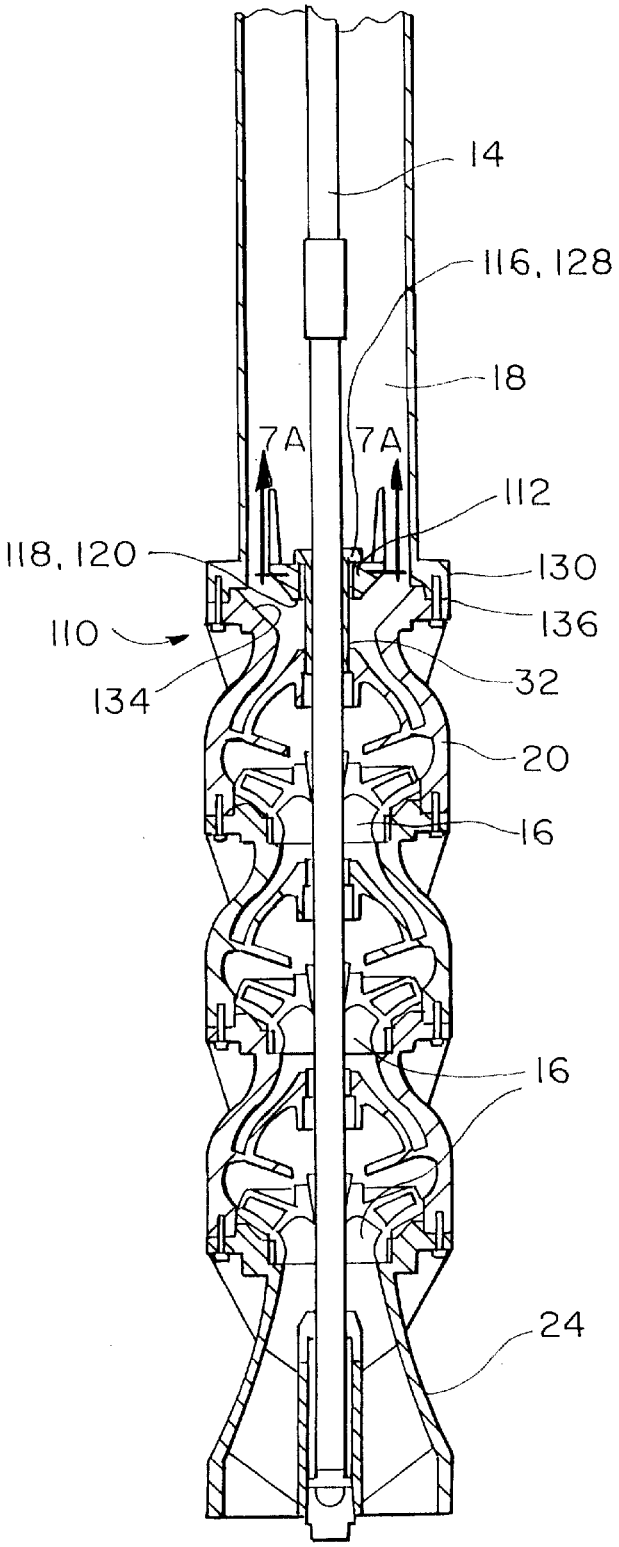
FIG. 7 is a schematic of a product-lubricated turbine pump showing a fifth embodiment of the invention.
Figure 7A:
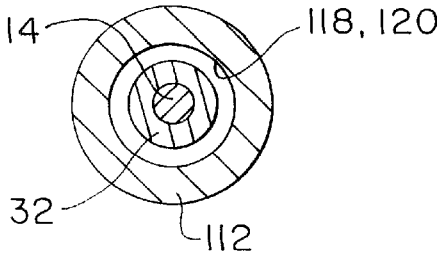
FIG. 7A is a cross-section along the lines 7A of FIG. 7.

FIG. 7 shows a fifth embodiment of the valve 110 within a product-lubricated pump 10 as described above.

Figure 8:
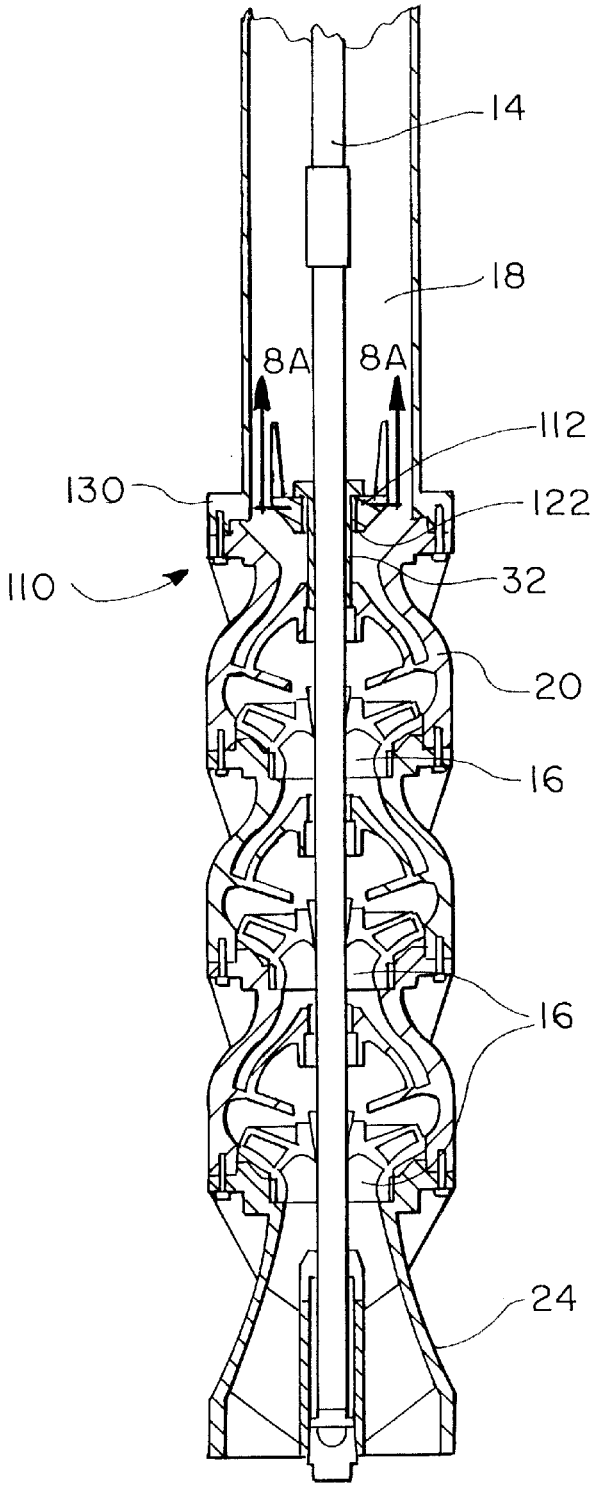
FIG. 8 is a schematic of a product-lubricated turbine pump showing a sixth embodiment of the invention.
Figure 8A:
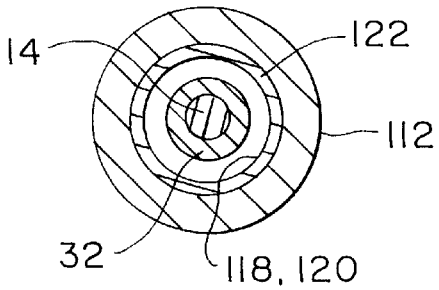
FIG. 8A is a cross-section along the lines 8A of FIG. 8.

FIG. 8 shows a sixth embodiment of the valve 110 within a product-lubricated pump 10. The sixth embodiment is the same as the fifth embodiment with the addition of a metallic insert 122 on the poppet 112. The poppet 112 is preferably composed of ductile iron, although it may be made from other materials such as stainless steel, brass, or carbon steel. If the poppet 112 is made of a rusting material such as ductile iron, the metallic, non-rusting insert 122 is necessary to allow free movement of the poppet 112 along the throttle bearing 32. It should be noted that the preferably 0.080 inch gap is still present between the metallic insert 122 and the throttle bearing 32, to allow self-draining.

Figure 9:
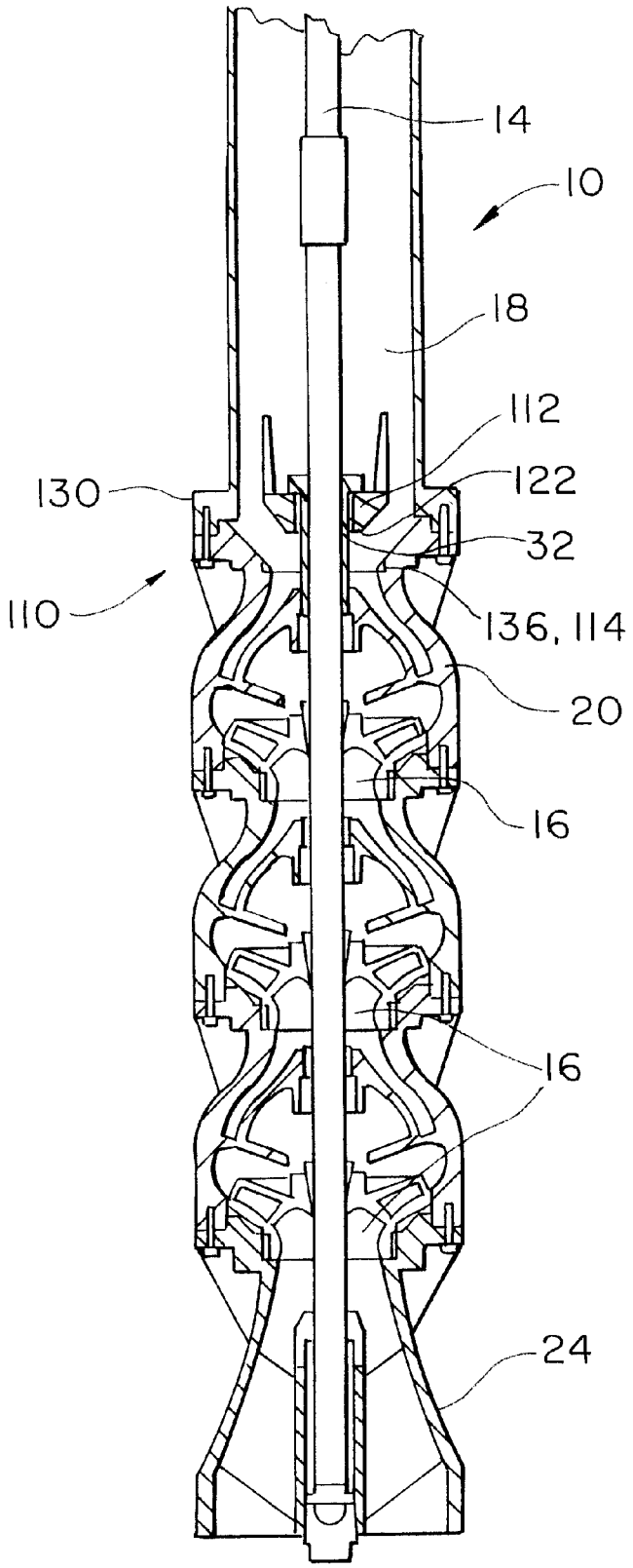
FIG. 9 is a schematic of a product-lubricated turbine pump showing a seventh embodiment of the invention.

FIG. 9 shows a seventh embodiment of the valve 110 within a product-lubricated pump 10. The seventh embodiment is the same as the fifth embodiment or sixth embodiment with the addition of a metallic adapter 124 to the coupling ring 130. The metallic adapter 124 is located at the portion 136 of the coupling ring 130 where the poppet 112 engages the coupling ring 130. The metallic adapter 124 thus acts as a valve seat 114 for the poppet 112. Thus, if the coupling ring is made out of a rusting metal, such as ductile iron, the non-rusting adapter 124 provides a secure valve seat. Preferably, the adapter 124 is made of brass.

Figure 10:
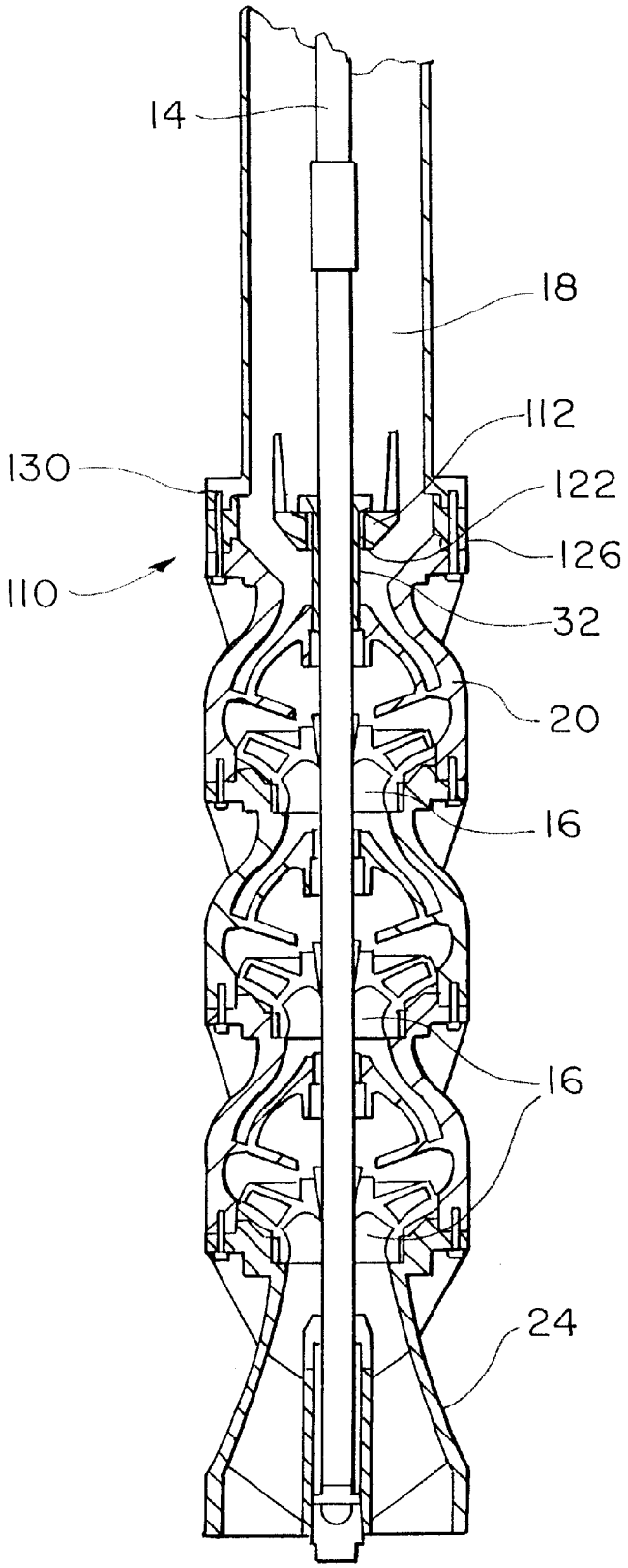
FIG. 10 is a schematic of a product-lubricated turbine pump showing an eighth embodiment of the invention.

FIG. 10 shows an eighth embodiment of the valve 110 within a product-lubricated pump 10. The eighth embodiment is the same as the fifth embodiment or sixth embodiment with the addition of a spacer 126 to the coupling ring 130. Some coupling rings may not be large enough to accommodate travel of the poppet 112 from the closed to the open position. The spacer 126 enlarges the coupling ring to provide space within the coupling ring 130 for travel of the poppet 112.

In all of the above-described embodiments, the weight of the poppet is preferably slightly less than the maximum fluid pressure developed by the pump, so that a decrease in the fluid pressure below the maximum fluid pressure allows the poppet 112 to gradually close, thus preventing water hammer due to the weight of fluid in the column pipe above the valve. A typical weight of the poppet is about six pounds. However, it should be apparent that the weight of the poppet can very over a wide range, depending on the diameter of the column pipe. The weight of the poppet may preferably be in the range of six ounces to two thousand pounds.

The operation of the valve of the present invention will now be described in reference to the foregoing and to FIGS. 11 through 13.

Figure 11:
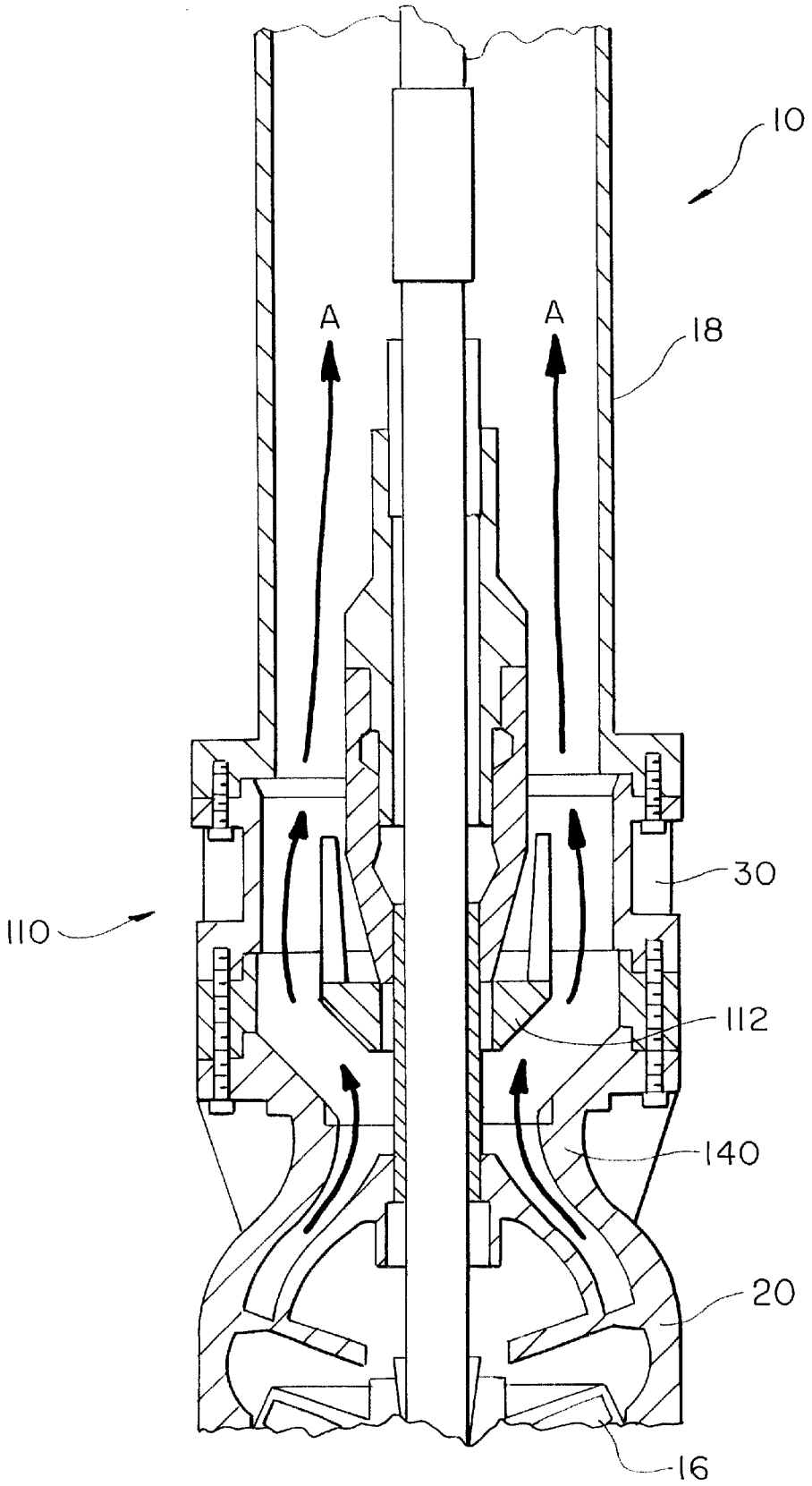

As can be seen in FIG. 11, when the pump 10 is on, fluid pressure pushed the poppet 112 upwards against the force of gravity, enabling high fluid pressure flow as indicated by the large arrows A in the Figure. Fluid flow is restricted at the venturi 140 of the bowl 20. Placement of the poppet 112 slightly above the venturi 140 does not produce significant additional restriction on fluid flow. Fluid flows past the poppet 112 into the discharge case 30 (in the case of an oil-lubricated pump) and then into the column pipe 18. The same operation applies for a product-lubricated pump.

Figure 12:
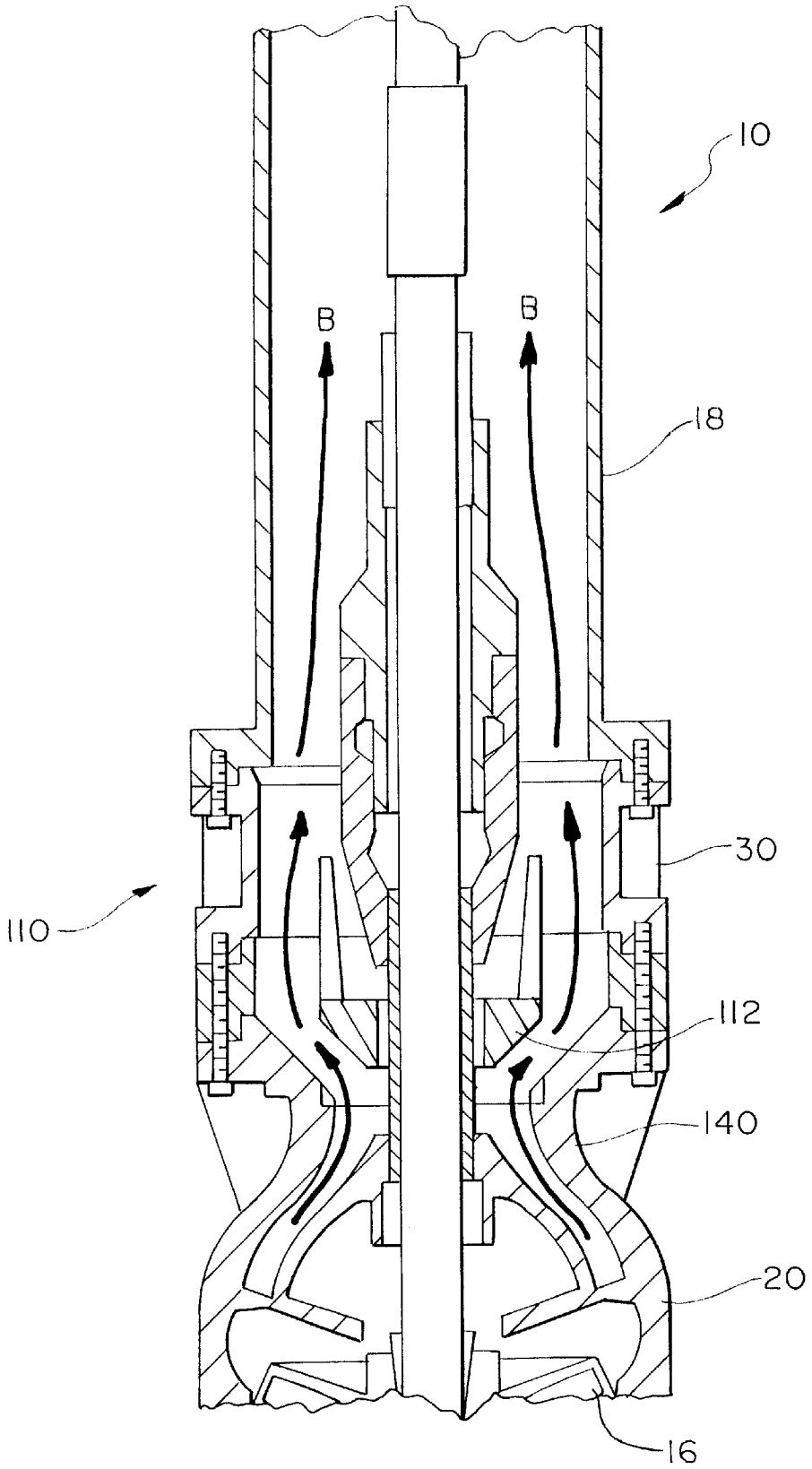
FIG. 12 is a schematic of the valve of the present invention within a turbine pump showing the position of the valve immediately after the pump is turned off.

In FIG. 12, the pump has been shut off. Decreased fluid pressure is indicated by the small arrows B in the Figure. However, the valve 110 does not close immediately. The weight of the poppet 112 has begun to bias the poppet 112 toward the closed position, but there is still enough fluid pressure to keep the valve slightly open. This is important to avoid water hammer which would be caused by an abrupt closing of the valve 110.

Figure 13:
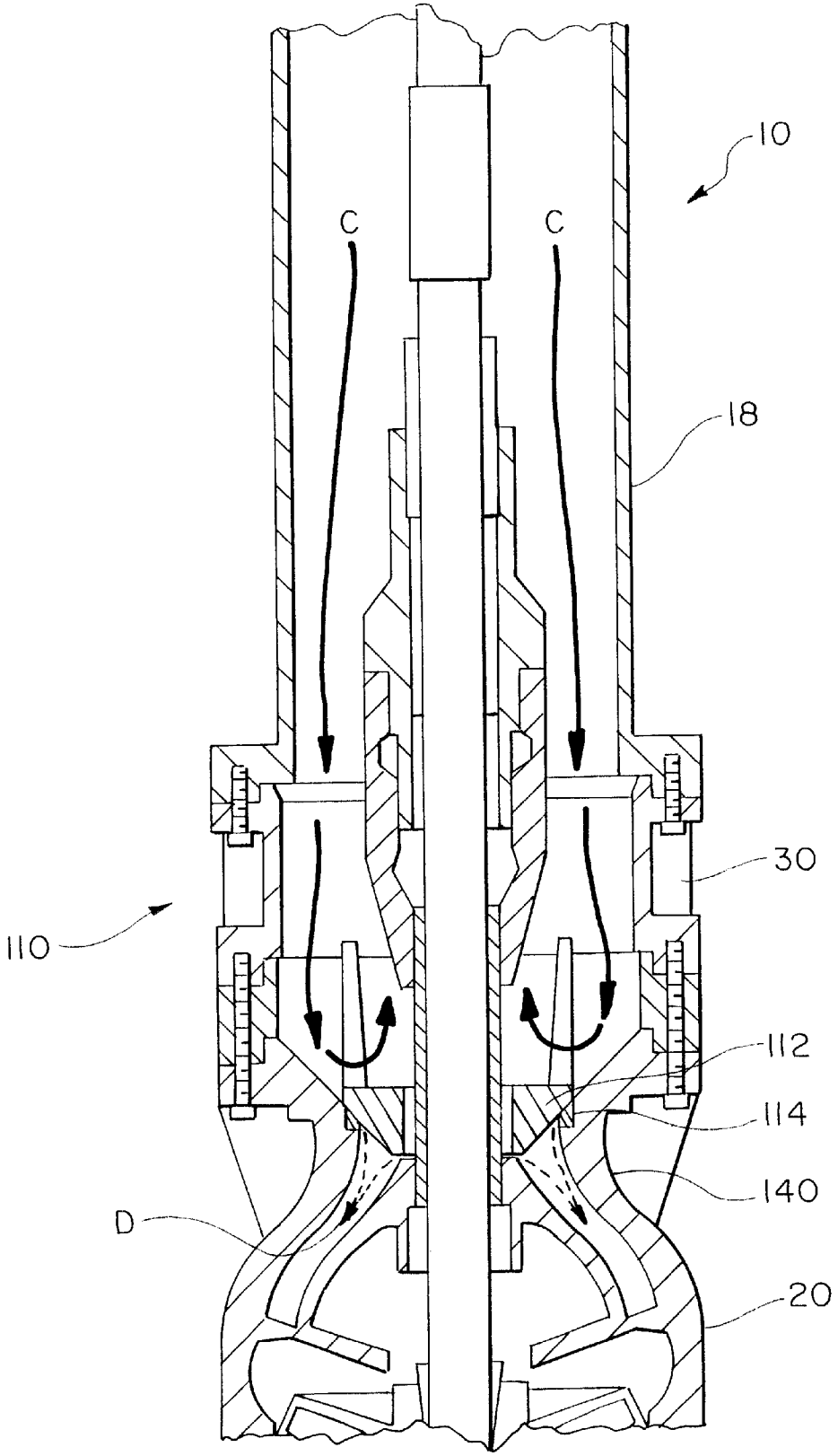
FIG. 13 is a schematic of the valve of the present invention within a turbine pump when all fluid flow has ceased.

In FIG. 13, fluid pressure has diminished to the point at which the fluid pressure is no longer sufficient to overcome the weight of the poppet 112. Accordingly, the poppet 112 has engaged the valve seat 114. Elimination of fluid pressure now causes a backflow of fluid down the column pipe 18 as indicated by the large arrows C. However, this backflow is prevented from reaching the impellers 16 because the valve 110 is closed. Furthermore, a small amount of seepage past the poppet 112 is permitted when the poppet 112 is in the closed position, in order to allow self-draining of the fluid column in the column pipe. The small arrows D indicate that seepage may occur through the gap 120 and also past the valve seat 114, which does not provide a perfect seal.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A gravity-operated anti-surge valve for a turbine pump producing fluid pressure, comprising a poppet adapted to be moveable under fluid pressure between a closed position and an open position and a valve seat for the poppet, the poppet having a weight, the weight biasing the poppet in the closed position against the valve seat in the absence of fluid pressure, and further comprising a self-draining channel extending vertically through the poppet, whereby fluid drains through the poppet in the closed position.

2. In a turbine pump, the pump having a plurality of impellers, a bowl above the impellers, a column pipe above the bowl, a lineshaft driving the impellers and the lineshaft enclosed by the column pipe, the impellers producing fluid pressure to drive fluid through the column pipe against the force of gravity, the improvement comprising a gravity-operated valve having a poppet adapted to be moveable under fluid pressure between a closed position and an open position and a valve seat for the poppet, the poppet having a weight, the weight biasing the poppet in the closed position against the valve seat in the absence of fluid pressure, wherein said poppet slidingly engages the lineshaft of the pump above the bowl, further comprising self-draining means for allowing gradual drainage of fluid in the column pipe above said valve when said poppet is in the closed position, the self-draining means further comprising a channel between the lineshaft and the poppet.

3. The valve of claim 2, further comprising retainer means for restraining the movement of said poppet on the lineshaft in a direction away from the bowl.

4. A gravity-operated anti-surge valve for an oil-lubricated turbine pump of the type having a plurality of impellers, a bowl above the impellers, and a column pipe above the bowl, a lineshaft driving the impellers and the lineshaft enclosed by the column pipe, a throttle bearing enclosing a portion of the lineshaft, and a discharge case, the impellers producing fluid pressure to drive fluid through the column pipe against the force of gravity, the valve comprising a poppet adapted to slidingly engage the throttle bearing above the bowl and said poppet moveable under the fluid pressure between a closed position and an open position, and a valve seat for the poppet, the poppet having a weight, the weight biasing said poppet in the closed position in the absence of fluid pressure, further comprising self-draining means for allowing gradual drainage of fluid in the column pipe above said valve when said poppet is in the closed position, wherein the self-draining means further comprises a space between the poppet and the throttle bearing extending vertically through the poppet.

5. The valve of claim 4, further comprising retainer means for restraining the movement of said poppet on the lineshaft in a direction away from the bowl.

6. The valve of claim 4, wherein the weight of said poppet is slightly less than the maximum fluid pressure developed by the pump, whereby a decrease in the fluid pressure below the maximum fluid pressure allows said poppet to gradually close, thus preventing water hammer due to the weight of fluid in the column pipe above the valve.

7. The valve of claim 4, further comprising a metallic insert engaging said poppet and moveable with said poppet and separating said poppet and the lineshaft.

8. The valve of claim 7, wherein said metallic insert is brass.

9. The valve of claim 4, further comprising a metallic adapter adapted to be inserted into the discharge case and engaging said poppet when said poppet is in the closed position, the adapter acting as a valve seat.

10. The valve of claim 9, wherein said adapter is brass.

11. The valve of claim 4, further comprising a spacer inserted in the discharge case and adapted to space the column pipe from the bowl, thereby providing space within the discharge case for said poppet.

12. The valve of claim 4, wherein the space between the throttle bearing and said poppet is about 0.080 inch.

13. The valve of claim 4, wherein the discharge case restrains the movement of said poppet on the lineshaft in a direction away from the bowl.

14. A gravity-operated anti-surge valve for a product-lubricated turbine pump of the type having a plurality of impellers, a bowl above the impellers, and a column pipe above the bowl, a lineshaft driving the impellers and the lineshaft enclosed by the column pipe, and a coupling ring connecting the column pipe to the bowl, the impellers producing fluid pressure to drive fluid through the column pipe against the force of gravity, the valve comprising a poppet adapted to slidingly engage the lineshaft above the bowl and said poppet moveable under fluid pressure between a closed position, and a valve seat for the poppet, the poppet having a weight, the weight biasing said poppet in the closed position in the absence of fluid pressure, further comprising self-draining means for allowing gradual drainage of fluid in the column pipe above said valve when said poppet is in the closed position, further comprising a throttle bearing engaging a portion of the lineshaft and wherein the self-draining means comprises a space between the poppet and the throttle bearing extending vertically through the poppet.

15. The valve of claim 14, further comprising retainer means for restraining the movement of said poppet on the lineshaft in a direction away from the bowl.

16. The valve of claim 14, wherein the weight of said poppet is slightly less than the maximum fluid pressure developed by the pump, whereby a decrease in the fluid pressure below the maximum fluid pressure allows said poppet to gradually close, thus preventing water hammer due to the weight of fluid in the column pipe above the valve.

17. The valve of claim 14, further comprising a metallic insert engaging said poppet and moveable with said poppet and separating said poppet and the lineshaft.

18. The valve of claim 17, wherein said metallic insert is brass.

19. The valve of claim 14, further comprising a metallic adapter adapted to be inserted into the coupling ring and engaging said poppet when said poppet is in the closed position, the adapter acting as a valve seat.

20. The valve of claim 19, wherein said adapter is brass.

21. The valve of claim 14, further comprising a spacer inserted in the coupling ring and adapted to space the column pipe from the bowl, thereby providing space within the coupling ring for said poppet.

22. The valve of claim 14, wherein the space between the throttle bearing and said poppet is about 0.080 inch.

23. The valve of claim 14, wherein said throttle bearing has a stop and said stop restrains the movement of said poppet on the lineshaft in a direction away from the bowl.

* * * * *